United States Patent [19]

Naylor

[11] Patent Number: 4,655,145

[45] Date of Patent: Apr. 7, 1987

[54] COIN SAFE CONSTRUCTION

[76] Inventor: John T. Naylor, 4150 Dunkirk, Toledo, Ohio 43606

[21] Appl. No.: 803,607

[22] Filed: Dec. 2, 1985

[51] Int. Cl.[4] ..... E05G 1/04

[52] U.S. Cl. ..... 109/52; 109/50

[58] Field of Search ..... 109/50, 51, 52, 45, 109/66

[56] References Cited

U.S. PATENT DOCUMENTS

| | | | |
|---|---|---|---|
| 3,610,176 | 10/1971 | Fujiki | 109/52 X |
| 3,871,284 | 3/1975 | Krise | 109/64 X |
| 3,979,054 | 9/1976 | Graham | 109/50 X |
| 4,043,279 | 8/1977 | Padgett | 109/50 |
| 4,296,617 | 10/1981 | Campagna | 109/50 X |
| 4,493,268 | 1/1985 | Sidler | 109/52 |

*Primary Examiner*—William F. Pate, III
*Assistant Examiner*—Creighton Smith
*Attorney, Agent, or Firm*—Marshall & Melhorn

[57] ABSTRACT

A tamper-proof coin safe including a cylindrical housing having an open end and a closed end together with a drawer insertable within the open end in recessed relation to the interior of the housing. The drawer includes a closure door which snugly fits the interior of the housing and bears against stops to maintain the drawer in the recessed position. A rotatable locking mechanism mounted in the drawer and operable by a key detachably secures the drawer within the housing.

4 Claims, 4 Drawing Figures

COIN SAFE CONSTRUCTION

BACKGROUND OF THE INVENTION

This invention generally relates to tamper-proof coin collection boxes and, more particularly, to a novel safe construction that is substantially jimmy-proof and not susceptible to unauthorized access to the contents of the safe.

Coin control devices, such as those employed in outdoor coin-operated car washing systems, are mainly left unattended for use by the public. Accordingly, the coin collection boxes are vulnerable to acts of vandalism and burglary by vandals who continually attempt to gain access to the coins deposited in the boxes. Many types of tamper-proof coin collection boxes have been previously produced, one example being illustrated in U.S. Pat. No. 3,871,284. The coin collection box structure illustrated in the aforementioned patent embodies a circular cover fitted to the end of a cylinder wherein the cover is retained therein, in flush relation, by a threaded bolt, the bolt being covered by a barrel-type lock. However, the aforedescribed coin collection box construction is susceptible to having a jimmy-bar hammered into the juncture between the cover and the cylinder and pried to-and-fro which destroys the cover and permits access to the interior of the cylinder.

SUMMARY OF THE INVENTION

Briefly, the structure of the coin safe constructed in accordance with the invention overcomes the aforementioned disadvantages by recessing a flat circular shaped closure member within a cylindrical housing whereby a jimmy-bar hammered into the juncture between the closure member and the housing is prevented from being pried to-and-fro and destroying the closure member. In addition, the closure member serves as the head end of a drawer and includes a locking mechanism having an integral rod which extends horizontally from the interior of the closure member and is rotatable about its horizontal axis. The distal end of the rod is externally threaded for being threadably received within an internally threaded fitting affixed to the end wall of the cylinder housing opposite the closure member for securely coupling the closure member and drawer combination within the cylindrical housing.

BRIEF DESCRIPTION OF THE DRAWINGS

The above, as well as other objections of the invention, will become readily apparent to one skilled in the art from reading the following detailed description of the preferred embodiment of the invention when considered in the light of the accompanying drawings in which.

DETAILED DESCRIPTION OF THE PREFERRED EMBODIMENT

Figure 1:
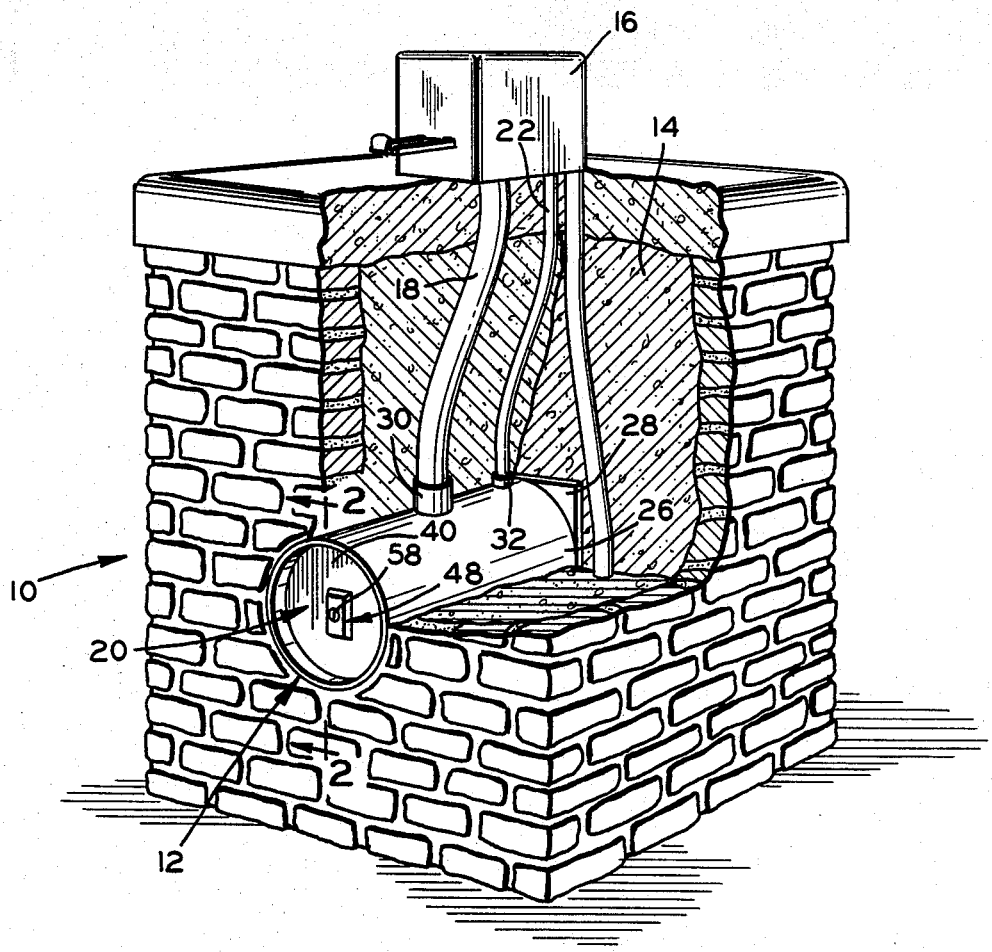
FIG. 1 is a perspective view of a coin safe constructed in accordance with the invention and installed in a pier for use in collecting and storing coins.

Referring to the drawings wherein like reference numerals designate similar parts throughout, FIG. 1 illustrates a coin storage system 10 comprising a coin safe construction 12 embedded in a pier 14 primarily formed of concrete. The system 10 includes a coin-operated timing meter 16 mounted on the upper surface of the pier 14 and coupled to the safe construction 12 by a coin inlet conduit 18. Thus when coins are deposited in the meter 16, they will pass through the conduit 18 into a drawer 20 contained within the interior of the safe construction 12. Also, another conduit 22 leading from the coin-operated timing meter 16 to the safe construction is provided for passing an electrical conductor (not shown) into the interior of the safe construction 12 for allowing an electrical heater (not shown) to be located in the interior of the safe 12 and operated to remove any condensation or moisture that may form on the interior surfaces of the safe construction. Also, the safe construction 12 may be provided with a drain hole 24 (See FIG. 2) at the bottom thereof for allowing any water which may accumulate for whatever reason within the safe construction 12 to drain out for protecting the operating mechanism of the safe.

Figure 2:
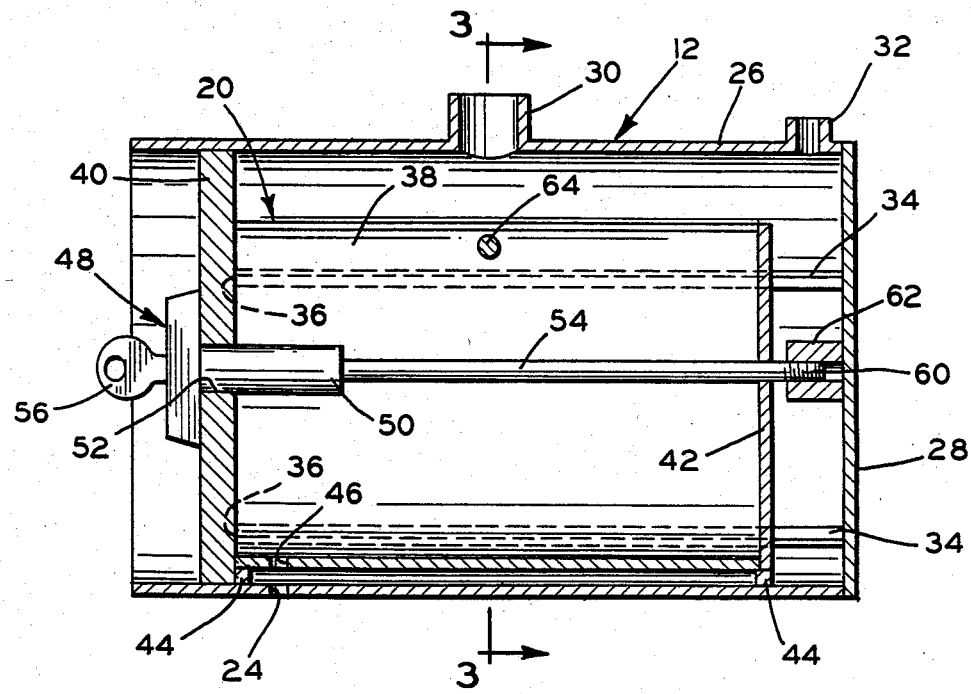
FIG. 2 is an enlarged side elevation sectional view taken substantially along line 2—2 of FIG. 1.
Figure 3:
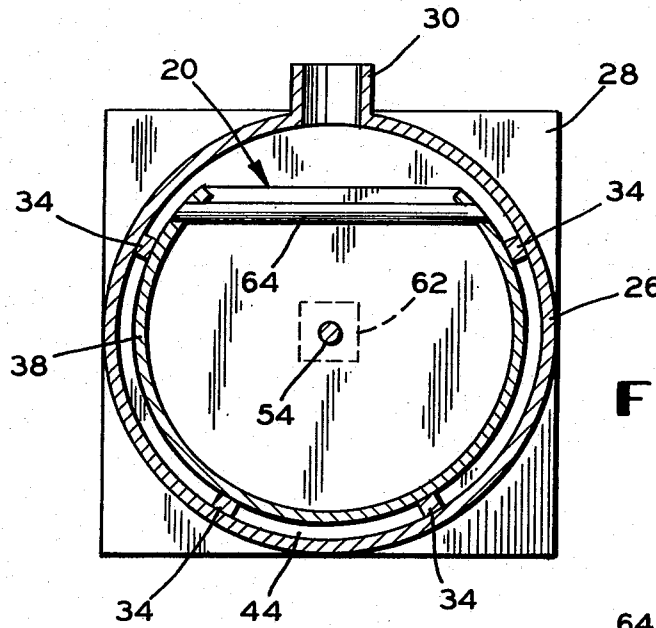
FIG. 3 is an enlarged cross-sectional view taken substantially along line 3—3 of FIG. 2.
Figure 4:
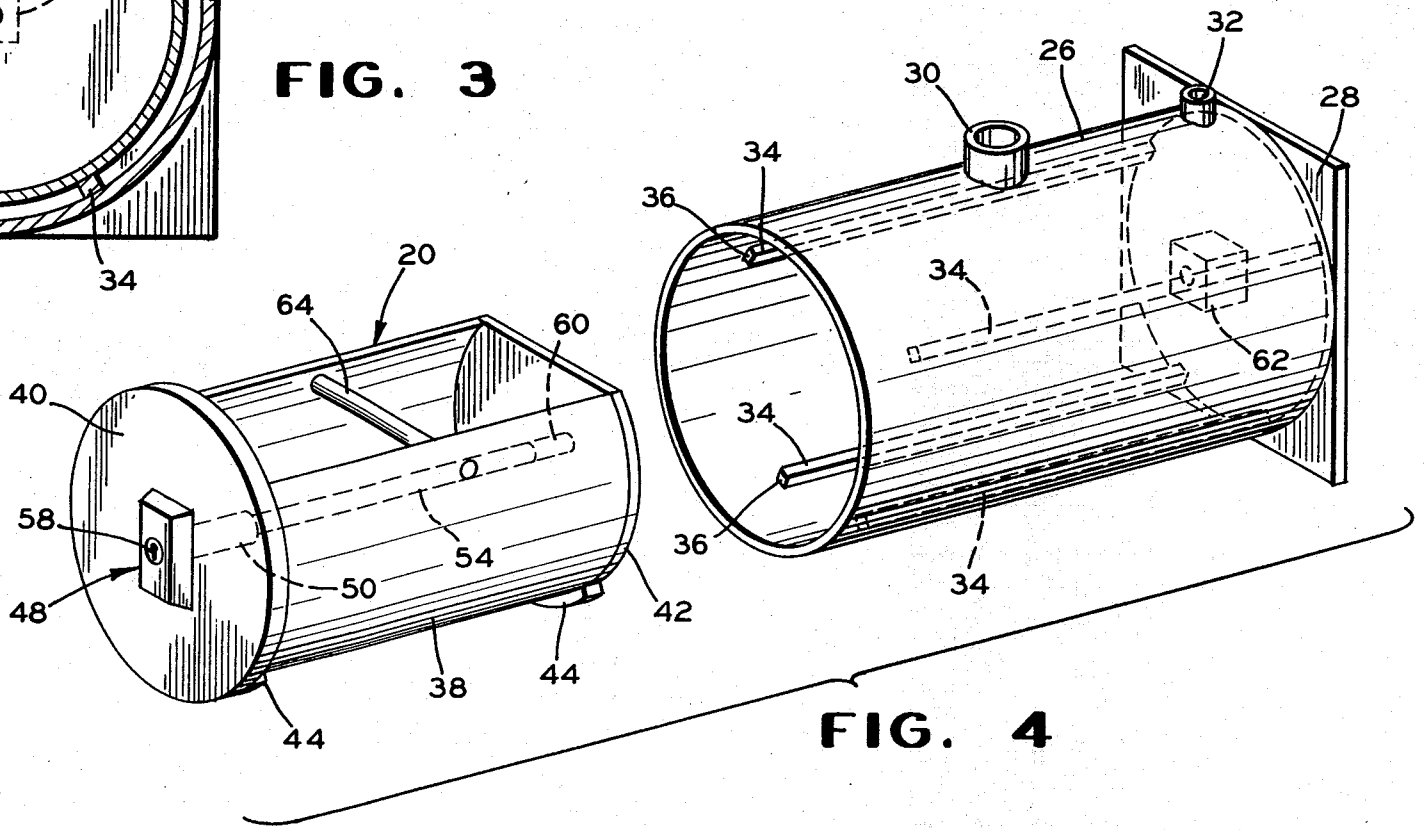
FIG. 4 is an enlarged, exploded perspective view of the coin safe construction illustrated in FIG. 1.

Referring particularly to FIGS. 2, 3 and 4, the coin safe construction 12 includes a cylindrical housing 26 having an end closed by a square shaped plate 28 which is affixed as by welding to the adjacent end of the housing 26. The portions of the plate 28 projecting beyond the outer surface of the cylindrical housing 26 provides means for securely embedding the cylindrical housing in the concrete pier 14. An appertured hub 30 disposed intermediate the ends of the cylindrical housing 26 is provided in the top surface thereof for receiving the adjacent end of the inlet conduit 18. Also, an appertured hub 32 is provided in the top surface of the housing 26 adjacent the closed end for receiving the adjacent end of the electrical conduit 22.

As best illustrated in FIG. 3, a number of circumferentially spaced supporting rail members 34 are provided on the interior surface of the cylindrical housing 26 for concentrically supporting the drawer 20 within the housing 26. Referring particularly to FIG. 2, the rail members 34 extend from the closed end of the housing to a location spaced from the open end of the housing and serve as abutments 36 for effectively maintaining the drawer 20 within the housing 26 in a predetermined recessed position.

Again referring particularly to FIGS. 2, 3 and 4, the drawer 20 includes a substantially cylindrically shaped member 38 having closed front and rear ends with an open top portion extending therebetween. The front end of the cylindrical member 38, shown at the left in FIGS. 2 and 4, is closed by a flat circular plate 40 which is sized to snugly fit within the open end of the cylindrical housing 26 (see FIG. 3) in abutting relation with the abutment 36. It should be noted that the flat circular plate 40 serves as a closure door for the safe construction 12. The rear end of the cylindrical member 38 is closed by a flat plate 42 which is shaped to conform to the end configuration of the member 38. The plates 40 and 42 may be affixed to the ends of the cylindrical member 38 by welds (not shown).

The bottom surface of the cylindrically shaped drawer member 38 is provided with a pair of longitudinally spaced, transversely extending arcuate members 44, the ends of which abut the corresponding sides of the adjacent rail members 34 for preventing rotation of the drawer 20 relative to the cylindrical housing 26. The bottom of the drawer 20 may be provided with a drain hole 46 (See FIG. 2) for draining any water occurring for any reason in the drawer 20.

The drawer 20 is detachably secured within the cylindrical housing 26 by a conventional locking mechanism 48. Referring primarily to FIGS. 2 and 4, the locking mechanism 48 is mounted in the closure plate 40 of the drawer 20 as a permanent part thereof. The locking mechanism 48 includes a lock portion 50 which passes through an aperture 52 provided in the plate 40. The lock portion 50 is secured to the plate 40 by any suitable means (not shown) and includes an integral shaft 54 which is rotatable by a key 56 insertable in a key slot 58 provided in the forward end of the lock portion 50. The distal end of the integral shaft 54 is provided with external threads 60 and is threadably received within an internally threaded fitting 62 secured, as by welding, to the inner surface of the plate 28 opposite the inner surface of the closure plate 40.

In operation, the drawer 20 is initially inserted in the open end of the cylindrical housing 26 and is effectively held in a recessed position by the inner face of the closure plate 40 bearing against the abutments 36. The key 56 is inserted into the key slot 58 to release the lock portion 50 allowing the shaft 54 to be rotated in either clockwise or counterclockwise directions. Rotation of the key 56 in one direction serves to disengage the threaded end of the shaft 54 from the fitting 62 thereby releasing the drawer from the housing 26. Rotation of the key 56 in the opposite direction serves to threadedly engage the threaded end of the shaft 54 with the internal threads of the fittings 62 thus securing the drawer 20 in the recessed position within the cylindrical housing 26. When the actuating key 56 is removed, the lock portion 50 is engaged and prevents rotation of the shaft 54 in both clockwise and counterclockwise directions.

The locking mechanism 48 could consist of a number of alternative configurations and designs, including the type consisting of a T-handle and associated locking mechanism. In such an embodiment, the key is employed to release a T-handle against the bias of an internal spring. The T-handle is then free to turn the shaft 54, and engage or disengage the threads 60 of the shaft 54 from the associated fitting 62.

A rod 64 may be mounted in the top portion of the cylindrical drawer member 38 transversely of and intermediate its ends to serve as a handle in inserting and removing the drawer 20 from the housing 26 of the safe construction.

In accordance with the provisions of the patent statutes, the principles and mode of operation of the invention has been explained and what is considered to represent its preferred embodiment has been illustrated and described. It should, however, be understood that the invention may be practiced otherwise than as specifically illustrated and described without departing from the spirit and scope.

What is claimed is:

1. A safe construction comprising:

(a) a cylindrical housing having a closed end and an open end;

(b) a substantially cylindrically shaped drawer having closed ends and an open portion extending therebetween, one of said said closed ends including a closure plate snugly receivable in the open end of said cylindrical housing;

(c) stop means disposed within said cylindrical housing and positioning said closure plate in recessed relation adjacent the open end of said cylindrical housing;

(d) a locking mechanism, including an elongate integral rod having a threaded distal end, said rod rotatably mounted in said closure plate with the distal end of the integral rod extending beyond the opposite end of said drawer, said locking mechanism having a locked position and an unlocked rotatable position; and (e) an internally threaded means fixed to the closed end of said cylindrical housing for threadedly receiving the threaded distal end of the integral rod of said locking mechanism whereby rotation of the locking mechanism in one direction causes a closure door and associated drawer to be snugly seated and held in a closed recessed position relative the open end of said housing and rotation of the locking mechanism in the opposite direction disengages the distal end of the integral rod from said internally threaded means and releases said drawer from said cylindrical housing.

2. The invention defined in claim 1 wherein said stop means comprises the end surfaces of a number of elongate strips affixed to the inner surface of said cylindrical housing in circumferentially spaced relation, said elongate strips extending longitudinally and intermediate the open and closed ends of said cylindrical housing for concentrically supporting said drawer within said housing.

3. The invention defined in claim 2 including means for preventing rotation of said drawer relative to said housing.

4. The invention defined in claim 3 wherein said means for preventing rotation of said drawer comprises at least one transversely extending arcuate member affixed to the outer surface of said drawer between a pair of adjacent strips affixed within the housing.

* * * * *